US005082469A

United States Patent [19]

Kain et al.

[11] Patent Number: 5,082,469

[45] Date of Patent: Jan. 21, 1992

[54] AMIDES OF POLYCARBOXYLIC ACIDS AS RHEOLOGICAL ADDITIVES FOR COAL-WATER SLURRIES

[75] Inventors: William S. Kain; Donald D. Staker, both of Cincinnati, Ohio

[73] Assignee: Henkel Corporation, Ambler, Pa.

[21] Appl. No.: 225,122

[22] Filed: Jul. 28, 1988

Related U.S. Application Data

[63] Continuation of Ser. No. 848,604, Apr. 7, 1986, abandoned.

[51] Int. Cl.[5] ..... C10L 1/32

[52] U.S. Cl. ..... 44/280; 44/386; 44/419

[58] Field of Search ..... 44/51, 66, 71, 280, 44/386, 419

[56] References Cited

U.S. PATENT DOCUMENTS

| | | | |
|---|---|---|---|
| 3,806,456 | 4/1974 | Vogel | 44/66 |
| 4,242,098 | 12/1980 | Branu et al. | 44/51 |
| 4,392,865 | 7/1983 | Grosse | 44/51 |
| 4,398,919 | 8/1983 | Zakaria | 44/51 |
| 4,534,450 | 1/1987 | Ljusberg-Wahren | 44/51 |

FOREIGN PATENT DOCUMENTS

| | | | |
|---|---|---|---|
| 57-155294 | 9/1982 | Japan | 44/51 |
| 58-80391 | 5/1983 | Japan | 44/51 |

*Primary Examiner*—Margaret B. Medley
*Attorney, Agent, or Firm*—Ernest G. Szoke; Wayne C. Jaeschke; Gerald A. Baracka

[57] ABSTRACT

Coal-water slurries containing a rheological additive are provided. Rheological additives employed for preparation of the coal-water slurries are amide products obtained by reaction of a polycarboxylic acid with a polyether diamine and, optionally, other amines or hydroxylic compounds. Salts of the amides may also be advantageously employed as dispersants. The additives are employed in an amount from about 0.1 to about 4 percent by weight to provide stable aqueous slurries containing from 60 to 80 percent by weight coal solids.

16 Claims, No Drawings

AMIDES OF POLYCARBOXYLIC ACIDS AS RHEOLOGICAL ADDITIVES FOR COAL-WATER SLURRIES

This is a continuation of patent application Ser. No. 848,604, filed Apr. 7, 1986, now abandon.

BACKGROUND OF THE INVENTION

1. Field of the Invention

This invention relates to coal-water slurries containing a rheological additive which is an amide obtained by the reaction of a polycarboxylic acid with a polyether diamine. A portion of the carboxyl groups may also be reacted with other amines or hydroxylic compounds. The amides are employed in an amount from about 0.1 to about 4% by weight of the coal-water slurry, the slurry having from about 60 to about 80% by weight solids—the balance being water.

2. Description of the Prior Art

In recent years there has been a great deal of interest in utilizing coal-water slurries in lieu of oil for electric power generation not only because of the lower cost of coal but also because of its availability.

Coal-water slurries have been produced which are fluid and handle in about the same way as petroleum fuels. Since the heat generated during combustion is sufficiently high, these coal-water slurries may be burned directly to generate power without dewatering. As the solids of the coal-water slurry is increased, the fuel value of the slurry also increases and it is generally not considered economically feasible to use slurries having less than about 50 to 55% solids.

One of the difficulties encountered with coal-water slurries at a solids content of about 60% and higher is that the dispersion becomes an immobile mass. Thus, for burning it has to be handled in the same manner as lump coal. Handling in this respect includes not only transportation of the coal from the mine source but also the delivery of the coal to a combustion chamber such as the firebox of a steam boiler. Unless coal-water slurries have the same liquidity as oil at these higher solids content so that they may be transported by pipeline and injected into a firebox by spraying, the advantage of using a liquid carrier (i.e., water) for the coal is lost. Stated otherwise, the particles of coal in the slurry at these higher solids levels tend to convert the liquid carrier (water) into a plastic mass whereby the advantage of employing a liquid carrier is lost.

The prior art has overcome some of these difficulties by providing additives which may be used in relatively small amounts to assure that the coal-water slurry at high solids content is fluid. For example, the use of alkali metal soaps of fatty acids is disclosed in U.S. Pat. No. 4,435,306. Numerous alkoxylated additives, including nitrogen-containing products, are also disclosed to be effective in the formulation of useful coal-water slurries. U.S. Pat. Nos. 4,358,293, 4,441,889, 4,477,259 and 4,478,603, describe the use of block polymers of ethylene and propylene oxide derived from nitrogen-containing compounds, such as ethylene diamine, and having molecular weights of at least about 14,000 as useful dispersants for the preparation of high solids content coal aqueous mixtures. Other nitrogen-containing materials, such as cocamidopropyl betaine and ammonium salts, are also disclosed in U.S. Pat. No. 4,477,259. In U.S. Pat. No. 4,398,919 coal-water slurries are prepared utilizing 0.1 to 0.5 weight percent of an ethoxylated fatty acid amide, such as polyoxyethylene (2) oleamide.

It would be highly advantageous if other additives obtained from readily available and economical materials were available and if coal-water slurries having high solids contents and which are stable for extended periods of time could be obtained by the use of these additives.

SUMMARY OF THE INVENTION

The present invention relates to coal-water slurries prepared using novel amide rheological additives comprising the reaction product of a polycarboxylic organic acid having from about 16 to 60 carbon atoms and from 2 to 4 carboxyl groups with a polyether diamine having a molecular weight from about 1,000 to about 10,000 and, more preferably, from about 2,000 to about 6,000. The polyether diamines correspond to the formula $$H_2N\underset{\underset{CH_3}{|}}{CH}CH_2\left(OCH\underset{\underset{CH_3}{|}}{}CH_2\right)_a\left(OCH_2CH_2\right)_b\left(OCH_2\underset{\underset{CH_3}{|}}{CH}\right)_c NH_2$$

where a, b, and c are all integers greater than one and such that the prescribed average molecular weight is obtained. In addition to the polyether diamine other amines and/or hydroxylic compounds may also be reacted with the polycarboxylic acid. When other amines or other hydroxylic compounds are employed the ratio of polyether diamine to amine/hydroxylic compound reacted ranges from about 3:1 to 1:3. At least about $$\frac{100}{n} \text{ percent}$$

of the carboxyl functionality, where n is the number of carboxyl groups in the polycarboxylic acid, is reacted.

Polycarboxylic acids used for the preparation of the ester-amides of the invention are selected from the group consisting of dimer acids, trimer acids, adducts of unsaturated monocarboxylic acids or dimer acids with maleic anhydride in a molar ratio of about 1:1, adducts of linoleic acid or similar unsaturated monocarboxylic acids with acrylic-type acids in a molar ratio of about 1:1, and adducts of olefins having about 12 to about 40 carbon atoms with maleic acid or maleic anhydride in a molar ratio of about 1:1. Polyether diamines having molecular weights from about 2,000 to about 6,000 are particularly advantageous. Amine and hydroxylic compounds which can be reacted are selected from the group consisting of alkylamines having from 4 to 18 carbon atoms and at least 1 primary or secondary amine group; etheramines derived from ethylene oxide, propylene oxide or mixtures of ethylene oxide and propylene oxide and having 1 to 2 amine groups; hydroxylic compounds having from 1 to 18 carbon atoms and 1 or 2 hydroxyl groups; and alkanolamines having from 2 to 12 carbon atoms, 1 to 3 amine groups, and 1 to 3 hydroxyl groups.

In one embodiment of the invention all or a portion of any carboxyl groups which are not reacted with the polyether amine or other amine or hydroxylic compound to form ester or amide moieties are converted to a salt form. The salts can be amine salts wherein the amine is the same or different than that employed for the amide reaction, salts of ammonia, salts of Group IA or IIA metals, especially sodium or potassium, or mixtures of said salts.

DETAILED DESCRIPTION OF THE INVENTION

The rheological additives used to obtain the coal-water slurries of this invention are amide products obtained by reacting a polycarboxylic acid with a polyether diamine. The polycarboxylic acid can be essentially completely reacted or, as is more generally the case, a portion of the carboxyl moieties can be unreacted. In another embodiment of the invention, a portion of the carboxyl moieties are reacted with a second amine or with a hydroxylic compound. In the latter case, the polycarboxylic acid may be reacted with a mixture of polyether diamine and second amine compound or polyether diamine and hydroxyl-containing compound or, as is more generally the case, the reactions may be carried out in a sequential, i.e., stepwise, manner. In yet another embodiment a portion of the carboxyl groups are converted to a salt form.

Polycarboxylic organic acids employed to obtain the amide products of the invention have from about 16 to about 60 and, more preferably, from 21 to about 54, carbon atoms, and contain from 2 up to about 4 carboxyl groups. The acids may be either dimer acids, trimer acids, adducts of unsaturated monocarboxylic acids or dimer acids with maleic anhydride in a molar ratio of about 1:1, adducts of linoleic acid and similar unsaturated monocarboxylic acids with acrylic-type acids in a molar ratio of about 1:1, or adducts of olefins having about 12 to about 40 carbon atoms with maleic acid or maleic anhydride in a molar ratio of about 1:1.

Dimer acids are known in the art and are described by Barrett et al. in U.S. Pat. No. 2,793,220 and Myers et al. U.S. Pat. No. 2,955,121 which are incorporated herein by reference. Trimer acids are also known in the art and are describe by Barrett et al. in U.S. Pat. No. 3,097,220 which is incorporated herein by reference. The dimer acid is obtained by oligomerizing an unsaturated 18 carbon atom naturally occurring unsaturated acyclic monocarboxylic fatty acid such as oleic acid, linoleic acid, linolenic acid and the like to obtain a 36 carbon atom dicarboxylic acid whereas the trimer acid is obtained by oligomerizing the foregoing unsaturated monocarboxylic acids to obtain a 54 carbon atom tricarboxylic acid. In both of these reactions, other products are obtained; however, the reaction is conducted in a manner so that the reaction product is principally the dimeric or the trimeric acid. Other unsaturated acyclic monocarboxylic acids having at least one ethylenically unsaturated position and from about 10 to about 22 carbon atoms can also be used to obtain polycarboxylic acids used in the invention. These include decenoic, undecenoic, pentadecenoic, hexadecenoic acids and the like. Unsaturated acyclic monocarboxylic acids of the above types may be obtained from natural fats and oils such as tall oil, linseed oil, tung oil, soy oil, rapeseed oil, corn oil, fish oil, beef tallow and mixtures thereof.

Dimer acids prepared as described in the foregoing references containing 75% or more of dimer acid and trimer acids prepared according to the foregoing references having 60% or more of trimer acids are especially advantageous polycarboxylic acids for the preparation of the present amide additives. Mixtures of dimer acid and trimer acid are also useful and may be advantageously employed.

Adducts of maleic anhydride (or acid) with unsaturated monocarboxylic acids and dimer acids are known in the art and are described in U.S. Pat. Nos. 2,902,499 and 2,975,133 which are incorporated herein by reference. These adducts are prepared by heating maleic anhydride and an unsaturated acid at a temperature from about 100° C. to about 300° C. until the addition reaction is completed. The molar ratio of the maleic anhydride to unsaturated acid is generally about 1:1.

The 21 carbon atom dicarboxylic acid which is the addition product of an 18 carbon atom monocarboxylic unsaturated acid (linoleic acid) and acrylic acid and designated Westvaco 1550 (trademark) may be employed as the polycarboxylic acid. Equivalent unsaturated monocarboxylic acids having at least two ethylenically unsaturated positions and from about 10 to about 22 carbon atoms reacted with an acrylic-type acid to produce a dicarboxylic acid may also be employed as the polycarboxylic acid. Other acrylic-type acids which may be used include crotonic acid, isocrotonic acid, vinylacetic acid, methacrylic acid and the like and mixtures thereof.

Useful polycarboxylic acids can also include adducts of maleic acid or maleic anhydride with an olefin, where the olefin has from about 12 to 40 carbon atoms and one or two unsaturated positions.

A polyether diamine, i.e., poly(lower oxyalkylene) diamine, is necessarily reacted with a portion of the carboxyl groups of the above-described polycarboxylic acids to obtain the amides useful for the present invention. The molecular weight of the polyether glycol ranges from about 1,000 to about 10,000 and, more preferably, from about 2,000 to about 6,000. The polyether diamines correspond to the formula $$H_2N\underset{\underset{CH_3}{|}}{C}HCH_2\left(OCH\underset{\underset{CH_3}{|}}{C}H_2\right)_a\left(OCH_2CH_2\right)_b\left(OCH_2\underset{\underset{CH_3}{|}}{C}H\right)_c NH_2$$

where a, b, and c are all integers greater than one and such that the prescribed average molecular weight is obtained. Polyether diamines of this type are commercially available under the Jeffamine (trademark) ED-series. Mixtures of the above-described polyether diamines may also be used.

The polyether diamine may have either a broad or a narrow molecular weight distribution so long as the molecular weight, on average, is within the aforementioned ranges. These ranges apply not only to polyether diamines falling within the range, but also to polyether diamine mixtures having an average molecular weight within the aforesaid range. Commercial polyether diamines employed according to the present invention are within the aforementioned molecular weight ranges and the molecular weights thereof are average molecular weights. Some commercial polyether diamines that may be employed according to the present invention have average molecular weights of approximately 2000, 4000, and 6000 and are sold under the trademark Jeffamine ED-2001, Jeffamine ED-4000 and Jeffamine ED-6000, respectively.

Although the polycarboxylic acid and polyether diamine may be reacted to essentially completely react all of the available carboxyl groups of the polycarboxylic acid, more generally, only a portion of the carboxyl moieties are reacted with the polyether diamine. In one embodiment of the invention, the molar ratio of polyether diamine to polycarboxylic acid is about 1:2 up to n:1 where n is the number of carboxyl groups in the polycarboxylic acid. The remaining carboxyl functionality can be converted to the salt form or further reacted with other amine compounds and/or hydroxylic compounds. The amide products may also contain some unreacted carboxyl groups and in some cases this has been found to improve the performance of the rheological additives.

When the carboxyl functionality is reacted further, a mono- or diamine or mono- or dihydroxylic compound may be utilized. Compounds having mixed functionality, i.e., both amine and hydroxyl groups, may also be employed for this purpose. Useful amines include alkylamines having from 4 to 18 and, more preferably, 4 to 12 carbon atoms and at least one primary or secondary amine group and etheramines which are mono-or diamines of ethylene oxide, propylene oxide, or mixtures of ethylene and propylene oxides. Useful hydroxylic compounds include aliphatic monoalcohols and glycols having from 1 to 18 and, more preferably, 2 to 12 carbon atoms. Useful compounds having both amine and hydroxyl groups include alkanolamines having from 2 to 12 carbon atoms, 1 to 3 amine groups, and 1 to 3 hydroxyl groups.

Especially useful alkylamines are selected from the group consisting of 2-ethylhexylamine, dodecylamine, and N,N-dimethyl-1,3-diaminopropane. Etheramines which are advantageously employed include polyether monoamines of the formula $$R\text{-}(CH_2\underset{\underset{R'}{|}}{C}HO)_m CH_2\underset{\underset{CH_3}{|}}{C}HNH_2$$

where R is a radical selected from the group consisting of n—$C_{10-12}H_{21-25}O$—, n—$C_4H_9OCH_2CH_2O$—, and $CH_3OCH_2CH_2O$—, R′ is hydrogen or methyl, and m is an integer such that the average molecular weight is in the range 300 to 1,000 (available under the Jeffamine (trademark) M-series designation); polyether diamines of the formula $$H_2N\underset{\underset{CH_3}{|}}{C}HCH_2(OCH_2\underset{\underset{CH_3}{|}}{C}H)_x NH_2$$

where x is an integer such that the average molecular weight is in the range 200 to 1,000 (available under the Jeffamine (trademark) D-series designation); and polyether diamines of the type previously described, i.e., having the formula $$H_2N\underset{\underset{CH_3}{|}}{C}HCH_2(O\underset{\underset{CH_3}{|}}{C}HCH_2)_{a'}, (OCH_2CH_2)_{b'}, (OCH_2\underset{\underset{CH_3}{|}}{C}H)_{c'}, NH_2$$

where a′, b′, and c′ are positive integers such that the average molecular weight is less than 1,000. Particularly useful hydroxylic compounds are 2-ethylhexanol, n-decanol, and 2-ethyl-1,3-hexanediol. Highly useful alkanolamines include ethanolamine, diethanolamine, N-methyl ethanolamine, N-ethyl ethanolamine, isopropanolamine, diisopropanolamine, N-methyl isopropanolamine, N-ethyl isopropanolamine, and N-aminoethylethanolamine.

The rheological additives utilized for preparation of the coal-water slurries of this invention are reaction products of the aforementioned polycarboxylic acids with polyether diamines and, optionally, a second amine compound and/or hydroxylic compound. In the latter case, all of the reactants may be added to the reactor as a unit charge and reacted or the polycarboxylic acid can be reacted in a step-wise, i.e., sequential manner. Reaction of the polycarboxylic acid and the polyether diamine is accomplished in accordance with conventional amidation procedures and, when a hydroxylic compound is utilized, conventional esterification techniques are employed. If sequential reactions are used, different conditions can be used in the various steps. This is particularly advantageous if a hydroxylic compound is utilized after the polycarboxylic acid is partially reacted with the polyether diamine. Polymerization is avoided or minimized by controlling the degree of reaction and the molar ratio of reactants.

Since at least some of the carboxyl groups of the polycarboxylic acids are reacted with a polyether diamine, the rheological additives necessarily contain amide functionality. Ester moieties may, however, also be present if a hydroxylic compound is utilized in conjunction with the polyether diamine. While essentially all of the carboxyl groups of the polycarboxylic acid can be reacted with the polyether diamine and optional amine or hydroxylic compounds, this is not necessary. Some unreacted carboxyl functionality can be present, i.e., the product will have a measurable acid value (AV). Where there are unreacted carboxyl groups present, either as a result of insufficient amine and/or hydroxyl groups to react with all of the available COOH of the polycarboxylic acid or failure to carry the reaction to completion, amine salts of the polyether amine and any other amine reactants can be formed. In virtually all instances, some amine salt will be present. Therefore, as used herein the term "reaction product" is intended to encompass not only products wherein the carboxyl groups are reacted to amine or amide/ester moieties but also those products where a portion of the amine is associated with some of the carboxyl groups in the form of a salt.

The ester-amide rheological additives used for the present invention are reaction products of the aforementioned polycarboxylic acids, polyether glycols, and aliphatic amines and are obtained in accordance with known conventional reaction procedures. All of the reactants may be added to the reactor as a unit charge and reacted or the polycarboxylic acid can be partially reacted with one of the reactants and then, in a subsequent step, be further reacted with the second reactant. In the latter situation, i.e., sequential reaction, the two steps may be carried out under different conditions. Since higher temperatures are required for ester formation, the polycarboxylic acid is generally first reacted with the polyether glycol and the resulting partial ester product then reacted with the aliphatic amine. This is particularly advantageous when a low boiling amine is used. Polymerization is avoided or minimized by controlling the degree of reaction and the molar ratio of reactants.

Useful rheological additives for this invention have at least about $$\frac{100}{n} \text{ percent}$$

of the carboxyl functionality reacted, where n is the number of carboxyl groups in the polycarboxylic acid. Up to 100 percent of the available carboxyl functionality of the polycarboxylic acid can be reacted. These percentages are based on the acid value of the final product versus the acid value of the reactant mixture.

The acid value is generally used to follow the progress of the reaction and determine extent of reaction of the polycarboxylic acid. More generally and particularly when other amines or hydroxylic compounds are reacted with the polycarboxylic acid, about 55 to 99 percent of the carboxyl functionality is reacted, i.e., converted to amine or amide/ester. In a particularly useful embodiment when other amines or hydroxylic compounds are present, 90 to 99 percent of the carboxyl groups of the polycarboxylic acid are reacted. In such cases the ratio of polyether diamine to amine/hydroxylic reactant typically ranges from about 3:1 to about 1:3 and, more generally, is in the range 2:1 to 1:2 on a molar basis.

In addition to the amine salts which are formed as discussed above, in another embodiment of the invention all or a portion of any remaining carboxyl functionality, i.e., which are not reacted to amide or ester or in the salt form, is converted to other salt forms. These salts are also useful as rheological additives for the preparation of stable, high solids content coal-water slurries. The salts can be salts of ammonia, organic amines different than those described above, or Group IA or IIA metals of the Periodic Table of the Elements, particularly sodium or potassium. Illustrative organic amines which can be utilized for this purpose are aromatic amines and heterocyclic nitrogen-containing compounds such as pyridine, piperidine, piperazine, morpholine, and alkyl-substituted imidazolines. Mixtures of these salts can also be used. The presence of unreacted or unassociated carboxyl functionality is not detrimental to the invention. In fact, it can be advantageous when preparing slurries with certain types of coal.

Especially advantageous rheological stabilizers for use in the present invention are:

(A) The reaction product obtained when approximately one-half to substantially all of the carboxyl groups of a dimer acid is reacted with a polyether diamine having a molecular weight from about 2,000 to about 6,000;

(B) The reaction product obtained when approximately one-half to two-thirds of the carboxyl groups of a dimer acid is reacted with a polyether diamine having a molecular weight from about 2,000 to about 6,000 and substantially all or a portion of the remaining carboxyl groups are reacted with (1) an alkylamine selected from the group consisting of 2-ethylhexylamine, dodecylamine, and N,N-dimethyl-1,3-diaminopropane; (2) a polyether monoamine of the formula $$R\text{-}\left(CH_2\underset{\underset{R'}{|}}{C}HO\right)_m CH_2\underset{\underset{CH_3}{|}}{C}HNH_2$$

where R is a radical selected from the group consisting of n—$C_{10-12}H_{21-25}O$—,n—$C_4H_9OCH_2CH_2O$—, and $CH_3OCH_2CH_2O$—, R' is hydrogen or methyl, and m is an integer such that the average molecular weight is in the range 300 to 1,000; (3) a polyether diamine of the formula $$H_2N\underset{\underset{CH_3}{|}}{C}HCH_2\left(OCH_2\underset{\underset{CH_3}{|}}{C}H\right)_x NH_2$$

where x is an integer such that the average molecular weight is in the range 200 to 1,000; (4) a polyether diamine of the formula $$H_2N\underset{\underset{CH_3}{|}}{C}HCH_2\left(O\underset{\underset{CH_3}{|}}{C}HCH_2\right)_{a'}, \left(OCH_2CH_2\right)_{b'}, \left(OCH_2\underset{\underset{CH_3}{|}}{C}H\right)_{c'}, NH_2$$

where a', b', and c' are positive integers such that the average molecular weight is less than 1,000; (5) a hydroxylic compound selected from the group consisting of 2-ethylhexanol, n-decanol, and 2-ethyl-1,3-hexanediol; and (6) an alkanolamine selected from the group consisting of ethanolamine, diethanolamine, and N-aminoethanolamine; and (C) Amine, ammonium, sodium or potassium salts of A and B.

The coal-water slurries of the present invention are made from pulverized or powdered coal which has a particle size such that about 60% to about 90% will pass through a 200 mesh U.S. standard screen (a 75 micron sieve). Powdered or pulverized coal that may be converted into a water slurry is generally described by Funk in U.S. Pat. Nos. 4,282,006 and 4,416,666 both of which are incorporated herein by reference. The mixing of the powdered coal with water to form a slurry is also described by Funk in U.S. Pat. No. 4,477,260 at column 21, the entire disclosure of this reference being incorporated herein by reference. The rheological additives described above are combined with water and the water in turn is mixed with the coal in a mixer such as a Hobart (trademark) mixer or the various art known equivalents thereof.

About 0.1% to about 4% and, more preferably, 0.25 to 2.0% by weight, based on total slurry, of the amide additive is employed to obtain coal-water slurries having from about 60 to about 80% solids by weight. As a result of the use of the rheological additives, the resulting slurries are liquid at room temperature and easily pourable. Without the additives, the coal-water slurry is a non-pourable mass that is solid at room temperature. The slurries of the invention are generally maintained from about 0° C. up to about 95° C. and, more preferably, from about 2° C. to about 75° C.

The following Examples illustrate the invention more fully.

EXAMPLE I

An amide was prepared by reacting a commercially available dimer acid with an amount of commercially available polyether diamine to react with approximately one-half of the carboxyl of the polycarboxylic acid. For the reaction, 31.6 grams (0.1097 equivalent) dimer acid (Empol ® 1022 Dimer Acid manufactured by Emery Chemicals; AV 189-197; SV 191-199; dibasic acid content 77 percent) and 219.4 grams (0.0549 mole) polyether diamine having an average molecular weight of 4000 (Jeffamine ® ED-4000) were charged to a 500 ml glass reaction vessel equipped with a subsurface nitrogen inlet, thermometer and water trap/condenser assembly. The reaction mixture (AV 24.5) was heated at 180° C. and terminated after 3½ hours. The resulting partial amide product had an acid value of 12.1.

Coal-water slurries were prepared utilizing the above-prepared amide reaction product as follows: 1.75 g of the amide was dissolved in 61.5 grams of tap water with 0.18 g commercial defoamer and 4.38 g of a 1% aqueous solution of xanthan gum and 0.5% formaldehyde in the bowl of a Hobart mixer. The mixer bowl was then charged with 177.0 grams of freshly milled low-ash, low-sulfur Kanawha County West Virginia bituminous coal. This coal (98.8% dry matter) was milled to 98.0% smaller than 50 mesh (300 microns), 73.5% smaller than 200 mesh (75 microns), 68.6% smaller than 230 mesh (65 microns), and 61.1% smaller than 325 mesh (45 microns). The coal had an ash content of 7.14% and sulfur content of 0.65% on a dry basis. The amide dispersant, additives and coal were allowed to mix at low speed (No. 1) for approximately 1 hour during which time small water additions were made to the slurry to account for evaporative losses.

The coal-water slurry was then transferred to an 8-ounce bottle for viscosity determination using a Brookfield Viscometer LVF with a Helipath stand adaptor and an F spindle. Viscosity readings were made over a two inch volume of the slurry and averaged. The Brookfield viscometer was also used to measure a series of conventional viscosities using a number 4 spindle without the Helipath stand. Solids content of the slurry was determined by evaporation of water from a weighed portion of the slurry and found to be 72.2%. pH was determined with a Cole Parmer pH Wand and found to be 5.9. The viscosity at 6 rpm using the Helipath stand was initially 7,800 centipoise (cP) and 1,000 cP at 60 rpm by conventional determination. After 7 days no solids separation or settling was observed. The viscosity after 7 days was 14,000 cP at 6 rpm with the Helipath stand and 1,000 cP at 60 rpm by conventional means.

EXAMPLE II

Following the procedure of Example I, partial amides were prepared using a dimer acid (technical grade) obtained from the dimerization of tall oil. Approximately one-half of the carboxyl groups of the acid were reacted with the polyether diamine to form amide. For the reaction, 32.5 grams (0.1092 equivalent) acid which had a dimer/trimer content of about 65 percent and 218.5 grams (0.0546 mole) of the polyether diamine (average molecular weight 4,000) were charged and reacted at 170° C. for 2½ hours until the acid value dropped from 24.4 to 12.2. The resulting partial amide product was utilized for the preparation of coal-water slurries in accordance with the procedure of Example I. The slurry (72.4% solids and containing 1% of the partial amide) had an initial viscosity of 14,800 cP (6 rpm Helipath) and 1,000 cP (60 rpm conventional). No solids separation was evident when the slurries were stored for 7 days under ambient conditions and the viscosities were essentially the same as those initially obtained (14,000 cP and 1,000 cP, respectively).

Similar results were obtained utilizing products derived from other polycarboxylic acids. For example, amide dispersants were prepared from commercially available trimer acid (Empol® 1040 Trimer Acid), tetrapropenyl succinic acid, and $C_{21}$ dibasic acid (Westvaco® 1550) by reacting approximately one-half of the carboxyl functionality of each acid with Jeffamine® ED-4000. All of the resulting amide products were effective for the preparation of useful coal-water slurries. Uniform fluid slurries were obtained at solids contents at approximately 70 percent in all cases. The slurries were also stable when stored for up to 7 days under ambient conditions. The partial amide product (AV 10.6) derived from the trimer acid, for example, gave slurries which had initial viscosities of 12,500 cP (6 rpm Helipath) and 1,550 cP (60 rpm conventional). There was no water separation or evidence of settling of solids after 7 days' storage and the 60 rpm conventional viscosity was 1,000 cP.

EXAMPLE III

To demonstrate the effectiveness of the salt forms of the amide products as additives for coal-water slurries, a half-amide product prepared as described in Example I (1.75 grams) was dissolved in 60.8 grams water and the pH of the solution adjusted to 9.5 by the addition of ammonium hydroxide (conc.). The solution containing the ammonium salt of the partial amide was used to prepare an aqueous coal slurry containing 72.4 percent solids in the conventional manner. The initial viscosity of the slurry was 10,900 cP (6 rpm Helipath) and 9,400 cP (60 rpm conventional). After standing for 7 days there was no separation of water or solids and the respective viscosities were 9,400 cP and 1,200 cP.

EXAMPLE IV

A partial amide rheological additive was prepared in accordance with the procedure of Example I except that the polyether diamine employed had an average molecular weight of 6,000. The partial amide was obtained by reacting 109.7 grams (0.3812 equivalent) dimer acid and 1143.7 grams (0.1906 mole) Jeffamine® ED-6000 at 180° C. for 2 hours during which time the acid value of the reaction mixture dropped from 17.0 to 8.7. The resulting partial amide product was utilized as a dispersant at a 1% level for the preparation of a coal-water slurry containing 71.5% solids. The initial viscosity of the slurry was 3,100 cP (6 rpm Helipath) and 1,500 cP (60 rpm conventional). After standing for seven days there was no separation of solids and the respective viscosities were 9,400 cP and 1,300 cP.

EXAMPLE V

A partial amide was prepared in the conventional manner by reacting 51.0 grams (0.2255 equivalent) of a polybasic acid having a carboxyl functionality of approximately three obtained by the addition of dimer acid and maleic anhydride (1:1) with 451.0 grams (0.1128 mole) polyether diamine having an average molecular weight of about 4,000. The amidation reaction was carried out at 180° C. for 2 hours during which time the acid value of the reaction mixture was reduced from 25.2 to 9.8. Coal-water slurries prepared in the conventional manner utilizing the above-prepared product and containing 72.5 percent solids had viscosities of 9,400 cP (6 rpm Helipath) and 1,100 cP (60 rpm conventional). There was no evidence of phase separation in the slurries after 7 days and the viscosities were essentially the same as those initially observed.

EXAMPLE VI

Example I was repeated except that the ratio of reactants was varied. For this reaction 56.2 grams (0.1956 equivalent) dimer acid and 195.3 grams (0.0489 mole) of the polyether diamine were reacted. The reaction was carried out at 185° C. until an acid value of 23.1 was reached (10 hours). The initial reaction mixture had an acid value of 43.5. A coal-water slurry was prepared in the conventional manner using 1% of the described product, based on coal weight, and had initial viscosities of 12,500 cP (6 rpm Helipath) and 2,100 cP (60 rpm conventional) at 72.7% solids. The respective viscosities obtained after the slurry was allowed to stand for 7 days were 21,100 cP and 1,400 cP. No phase separation was evident after 7 days' storage.

EXAMPLE VII

To demonstrate the versatility of the present invention and the ability to obtain stable, uniform, fluid coal-water slurries when the partial amides are further reacted with a second amine, the following example is provided. The product was prepared utilizing a partial amide prepared in accordance with Example V. For the reaction, 176.8 g (0.0399 equivalent) of the partial ester and 25.3 g (0.0438 mole) polyether diamine having an average molecular weight of 600 were combined. The reaction mixture (AV 9.8) was heated at 180° C. for 6 hours until the acid value was 0.9. The resulting mixed amide product was used at a 1% level (based on coal weight) to prepare coal-water slurries. Kanawha County West Virginia coal and supplemental additives were employed in the formulation of the slurry as previously described. The slurry had a solids content of 72.5 and viscosities (in cP) were as follows:

| Viscosity | | | |
|---|---|---|---|
| Initial | | After 7 Days | |
| 6 rpm Helipath | 60 rpm Conventional | 6 rpm Helipath | 60 rpm Conventional |
| 17,200 | 1,700 | 7,800 | 1,400 |

After 7 days' storage there was no evidence of phase separation.

When the above reaction was repeated except that 2-ethylhexylamine was substituted for the polyether diamine (MW 600), a comparably effective product was obtained. The aqueous slurry (72.1% solids) prepared using this additive had viscosities of 23,400 cP (6 rpm Helipath) and 1,400 cP (60 rpm conventional). There was no significant change in the slurry viscosities after 7 days' storage and no phase separation was evident.

EXAMPLE VIII

In a manner similar to that described in Example VII, a portion of the carboxyl functionality of a partial amide was reacted with a second amine and the resulting products utilized as dispersants for the preparation of coal-water slurries. Two products were prepared—both utilized the partial amide prepared in accordance with the procedure of Example IV. For the first reaction (VIIIA), 243.3 grams (0.0371 equivalent) of the partial amide was combined with 8.1 grams (0.0408 mole) dodecylamine. The mixture (AV 8.4) was reacted at 180° C. for 25 hours until the acid value was reduced to 1.2. For the second reaction (VIIIB), 176.3 grams (0.0269 equivalent) of the partial amide was combined with 26.6 grams (0.0296 mole) polyether diamine having an average molecular weight of 900. This reaction mixture (AV 7.6) was reacted at 180° C. for 15 hours to an acid value of 0.75. Both of the above-prepared mixed amide products were effective dispersants for the preparation of coal-water slurries. Stable, uniform, fluid slurries were obtained as dispersant levels of 1–2%.

To further demonstrate the utility of these materials, the ammonium, sodium, and potassium salt of product VIIIA and the ammonium salt of product VIIIB were prepared and evaluated as dispersants for coal-water slurries. The salts were formed by dissolving 1.75 grams of the product in about 61 grams of water and then adjusting the pH to approximately 9.5 by the addition of the appropriate base. Slurries were prepared in the conventional manner using the salts thus obtained with the following results:

| | | Viscosity in cP | | | |
|---|---|---|---|---|---|
| | | Initial | | 7 Day Storage | |
| Dispersant (Salt-Type) | % Solids | 6 rpm Helipath | 60 rpm Conventional | 6 rpm Helipath | 60 rpm Conventional |
| VIIIA ($NH_4$+) | 71.1 | 6,200 | 1,000 | 4,700 | 1,400 |
| VIIIA (K+) | 72.1 | 4,700 | 1,300 | 14,000 | 1,100 |
| VIIIA (Na+) | 71.7 | 12,500 | 1,500 | 3,100 | 1,300 |
| VIIIB ($NH_4$+) | 72.3 | 14,000 | 1,500 | 12,500 | 1,300 |

EXAMPLE IX

In a manner comparable to that described in Example VII, a partial amide was reacted with a hydroxylic compound. The partial amide prepared in accordance with the procedure of Example IV was employed. For the reaction, 196.2 grams (0.0299 equivalent) partial amide was combined with 6.6 grams (0.0449 mole) 2-ethyl-1,3-hexanediol. This mixture (AV 8.4) was heated for 15 hours at 185°–225° C. The resulting reaction product (AV 2.5) was utilized as a dispersant for the preparation of a coal-water slurry (72.6% solids). The slurry had an initial viscosity of 7,000 cP (6 rpm Helipath) and 1,900 cP (60 rpm conventional). Upon storage for 7 days at ambient conditions there was no visible change in the characteristics of the slurry and the respective viscosities were 10,900 cP and 1,700 cP.

Partial amides were reacted in a similar manner with other hydroxylic compounds. In one experiment (IXA), 195.0 grams (0.0428 equivalent) of the partial amide prepared in accordance with Example I was reacted with 6.3 grams (0.0471 mole) dipropylene glycol. The reaction mixture (AV 11.8) was heated at 200° C. for about 14 hours and the resulting product had an acid value of 3.25.

In another experiment (IXB), 195.2 grams (0.0428 equivalent) of the partial amide prepared in accordance with Example I was combined with 6.1 grams (0.0471 mole) 2-ethylhexanol. This mixture (AV 11.8) was heated at 180° C. until the acid value was 3.2.

In still another experiment (IXC), 195.8 grams of the partial amide prepared in accordance with Example IV was reacted with 5.2 grams (0.0328 mole) n-decanol at 180°–185° C. until the acid value decreased from 8.5 to about 4. The ammonium and sodium salts of this product were also prepared (identified as IXD and IXE, respectively) in accordance with the usual salt-forming procedures.

The above-prepared products were utilized as rheological additives in the formulation of coal-water slurries with the following results:

| | | Viscosity in cP | | | |
|---|---|---|---|---|---|
| | | Initial | | 7 Day Storage | |
| Dispersant | % Solids | 6 rpm Helipath | 60 rpm Conventional | 6 rpm Helipath | 60 rpm Conventional |
| IXA | 72.7 | 10,900 | 2,000 | 10,900 | 900 |
| IXB | 72.6 | 34,600 | 3,300 | 15,600 | 1,600 |
| IXC | 72.3 | 4,700 | 1,500 | 12,500 | 1,400 |
| IXD | 72.1 | 15,600 | 32,200 | 3,900 | 1,200 |
| IXE | 72.1 | 28,100 | 2,500 | 7,000 | 1,500 |

All of the above-prepared slurries exhibited good stability upon storage.

What is claimed is:

1. A coal-water slurry containing 0.25 to 2.0 percent of a rheological additive consisting essentially of the reaction product obtained when approximately one-half to substantially all of the carboxyl groups of a dimer acid is reacted with a polyether diamine of the formula $$H_2N\underset{\underset{CH_3}{|}}{C}HCH_2\left(OC\underset{\underset{CH_3}{|}}{H}CH_2\right)_a\left(OCH_2CH_2\right)_b\left(OCH_2\underset{\underset{CH_3}{|}}{C}H\right)_c NH_2$$

wherein a, b, and c are integers such that the molecular weight is about 2,000 to about 6,000.

2. The coal-water slurry of claim 1 which contains about 60 to about 80 percent solids by weight.

3. The coal-water slurry of claim 2 wherein the coal ha a particle size such that about 60 percent to about 90 percent will pass through a 200 mesh U.S. standard sieve.

4. The coal-water slurry of claim 3 wherein the temperature of the slurry is maintained over a range from about 2° C. to about 75° C.

5. The coal-water slurry of claim 1 wherein a portion of the carboxyl functionality is converted to an amine, ammonium, sodium or potassium salt.

6. The coal-water slurry of claim 5 which contains about 60 to about 80 percent solids by weight.

7. The coal-water slurry of claim 6 wherein the coal has a particle size such that about 60 percent to about 90 percent will pass through a 200 mesh U.S. standard sieve.

8. The coal-water slurry of claim 7 wherein the temperature of the slurry is maintained over a range from about 2° C. to about 75° C.

9. A coal-water slurry containing 0.25 to 2.0 percent of a rheological additive consisting essentially of the reaction product obtained when approximately one-half to two-thirds of the carboxyl groups of a dimer acid is reacted with polyether diamine of the formula $$H_2N\underset{\underset{CH_3}{|}}{C}HCH_2\left(OC\underset{\underset{CH_3}{|}}{H}CH_2\right)_a\left(OCH_2CH_2\right)_b\left(OCH_2\underset{\underset{CH_3}{|}}{C}H\right)_c NH_2$$

wherein a, b, and c are integers such that the molecular weight is about 2,000 to about 6,000 and substantially all or a portion of the remaining carboxyl groups are reacted with (1) an alkylamine selected from the group consisting of 2-ethylhexylamine, dodecylamine, and N,N-dimethyl-1,3-diaminopropane; (2) a polyether monoamine of the formula $$R\left(CH_2\underset{\underset{R'}{|}}{C}HO\right)_m CH_2\underset{\underset{CH_3}{|}}{C}HNH_2$$

where R is a radical selected from the group consisting of n—$C_{10-12}H_{21-25}O$—,n—$C_4H_9OCH_2CH_2O$—, and $CH_3OCH_2CH_2O$—,R' is hydrogen or methyl, and m is an integer such that the average molecular weight is in the range 300 to 1,000; (3) a polyether diamine of the formula $$H_2N\underset{\underset{CH_3}{|}}{C}HCH_2\left(OCH_2\underset{\underset{CH_3}{|}}{C}H\right)_x NH_2$$

where x is an integer such that the average molecular weight is in the range 200 to 1,000; (4) a polyether diamine of the formula $$H_2N\underset{\underset{CH_3}{|}}{C}HCH_2\left(OC\underset{\underset{CH_3}{|}}{H}CH_2\right)_{a'}, \left(OCH_2CH_2\right)_{b'}, \left(OCH_2\underset{\underset{CH_3}{|}}{C}H\right)_{c'}, NH_2$$

where a',b', and c' are positive integers such that the average molecular weight is less than 1,000; (5) a hydroxylic compound selected from the group consisting of 2-ethylhexanol, n-decanol, and 2-ethyl-1,3-hexanediol; or (6) an alkanolamine selected from the group consisting of ethanolamine, diethanolamine, and N-aminoethanolamine.

10. The coal-water slurry of claim 9 which contains about 60 to about 80 percent solids by weight.

11. The coal-water slurry of claim 10 wherein the coal has a particle size such that about 60 percent to about 90 percent will pass through a 200 mesh U.S. standard sieve.

12. The coal-water slurry of claim 11 wherein the temperature of the slurry is maintained over a range from about 2° C. to about 75° C.

13. The coal-water slurry of claim 9 wherein a portion of the carboxyl functionality is converted to an amine, ammonium, sodium or potassium salt.

14. The coal-water slurry of claim 13 which contains about 60 to about 80 percent solids by weight.

15. The coal-water slurry of claim 14 wherein the coal has a particle size such that about 60 percent to about 90 percent will pass through a 200 mesh U.S. standard sieve.

16. The coal-water slurry of claim 15 wherein the temperature of the slurry is maintained over a range from about 2° C. to about 75° C.

* * * * *